US005109778A

United States Patent [19]

Berkowitz et al.

[11] Patent Number: 5,109,778

[45] Date of Patent: May 5, 1992

[54] FOLDING TABLE

[75] Inventors: Alan Berkowitz; Elliott W. Baum, both of St. Louis, Mo.; Curt Angel, St. Clair, Ill.

[73] Assignee: Berco Industries, St. Louis, Mo.

[21] Appl. No.: 677,501

[22] Filed: Apr. 29, 1991

[51] Int. Cl.[5] ..... A47B 3/08

[52] U.S. Cl. ..... 108/127; 108/117; 108/133; 248/188.6; 248/439

[58] Field of Search ..... 108/127, 129, 131, 133, 108/117; 248/188.6, 439

[56] References Cited

U.S. PATENT DOCUMENTS

| | | | |
|---|---|---|---|
| 1,881,047 | 10/1932 | Doman | 108/117 |
| 3,329,104 | 7/1967 | Gittings | 108/117 |
| 4,064,815 | 12/1977 | Baum | 248/188.6 X |
| 4,444,124 | 4/1984 | Burr | 108/131 |
| 4,597,553 | 7/1986 | Rorabaugh | 248/188.6 X |
| 5,014,628 | 5/1991 | Roberts | 108/133 |

FOREIGN PATENT DOCUMENTS

| | | | |
|---|---|---|---|
| 273454 | 10/1927 | Italy | 108/117 |
| 582154 | 11/1946 | United Kingdom | 108/131 |

*Primary Examiner*—Peter A. Aschenbrenner
*Attorney, Agent, or Firm*—Paul M. Denk

[57] ABSTRACT

A folding table is disclosed. The table includes legs pivotably connected to the underside of a table surface so that when the table is folded, the legs lay flat against the underside of the table. A locking mechanism is provided to lock the legs in an unfolded position, and a release mechanism is provided to unlock the legs, thereby allowing the table to be folded.

22 Claims, 11 Drawing Sheets

FOLDING TABLE

BACKGROUND OF INVENTION

This invention relates to folding tables, and, in particular to locking and release mechanisms for locking the legs in an upright, table supporting position and for releasing the table legs from the upright position to allow the table to be folded. More particularly, the table achieves a very solid operative structure at close tolerances to attain its benefical results.

Prior art folding tables, such as bridge tables, or other forms of conference tables, often have a leg pivotally connected to the table at each corner thereof. Each leg of these tables are often secured by a folding support arm which is held straight by a slide which covers the joint of the support arm. These slides are not securely fixed in place and may be loosened by jarring the table. When jarred, the slide may slide on the arm, exposing the joint of the support arm, thereby allowing the support arm to fold. Thus, the table may become unstable during use. Other forms of conference tables are somewhat loose in operation and when erected, lack the solid stability desired in a quality table.

SUMMARY OF THE INVENTION

One object of the present invention is to provide a low profile, easily stackable, folding table.

Another object is to provide such a folding table which is easy to fold and unfold.

Another object is to provide such a table which is easy to lock in an unfolded position and which is easy to release in order to fold the table.

Another object is to achieve a very stable table both in operation and usage.

These and other objects will become apparent to those skilled in the art in light of the following disclosure and accompanying drawings.

In accordance with this invention, generally stated, there is provided a folding table comprising a table surface having a top and a bottom, and at least one housing secured to the table surface bottom. The housing slidably and pivotally receives a pair of table legs, and includes means for moving the legs between a folded position and a supporting position, means for locking the leg in the supporting position, and means for releasing the legs from the locking means for their shifting into a collapsed and stronger condition.

The legs each include a floor contacting foot fixed to the bottom thereof, a release sleeve fixed to the top thereof, a column therebetween, and a support bar pivotably fixed at one end to the column intermediate the foot and the sleeve and at the other end to the housing. The housing comprises a pair of spaced apart, generally parallel side rails, each of which defines a groove therein extending the length thereof. A slide, supporting each end of the release sleeve, is slidably received in each of the housing grooves.

Each leg further includes a pinned assembly carried in the release sleeve which includes an axle pin rotatably received in each pair of opposing slides. One of each slide is slidably received in each the housing grooves. At least one of the slides includes a notch on an outer surface thereof opposite the surface adjacent the sleeve. The locking means comprises a lever pivotably fixed in each side rail and a catch on the lever which cooperates with the slide notch to lock the leg in a supporting position. The lever is biased to urge the catch toward the engaging notch.

Each slide includes a bore which receives the axle pin. At least one of the bores extends through the slide to the notch in at least one of the slides. The release means comprises extension means for extending the axle pin through the bore so that the axle pin will urge the catch out of the notch. The axle pin preferably comprises two pins, there being one pin on each end of the axle assembly. The extension means comprises a first and a second extender rod, all of which are operatively disposed in the release sleeve. The first extender rod is fixed to a first inner bushing, slidably received in a bore of a second inner bushing to pass therethrough and fixed to a first outer bushing. One of the axle pins is fixed to that outer bushing. The second extender rod is fixed to the second inner bushing, slidably received in a bore which extends through the first inner bushing, and fixed to a second outer bushing. The other of the axle pins is fixed to the second outer bushing. The first and second inner bushings are slidable relative to one another over the extender bars so that, when the inner bushings are brought together, the axle pins are extended. When the axle pins are extended, the axle pins extend through the slides' bores to urge each the catches out of their respective notches. Springs are preferrably mounted on the first and the second extender rods between the first and the second inner bushings to normally bias the extender means to a retracted position.

In a second embodiment, the release means comprises a pair of members slidably connected for axial movement relative to one another. Each member includes a body having an extender arm which is slidably received in the slide bore. When the members are moved relative to one another, the arms are extended through the bore to one another, the arms are extended through the bore to urge the lever catch out of the slide notch.

DESCRIPTION OF THE PREFERRED EMBODIMENT

Figure 1:
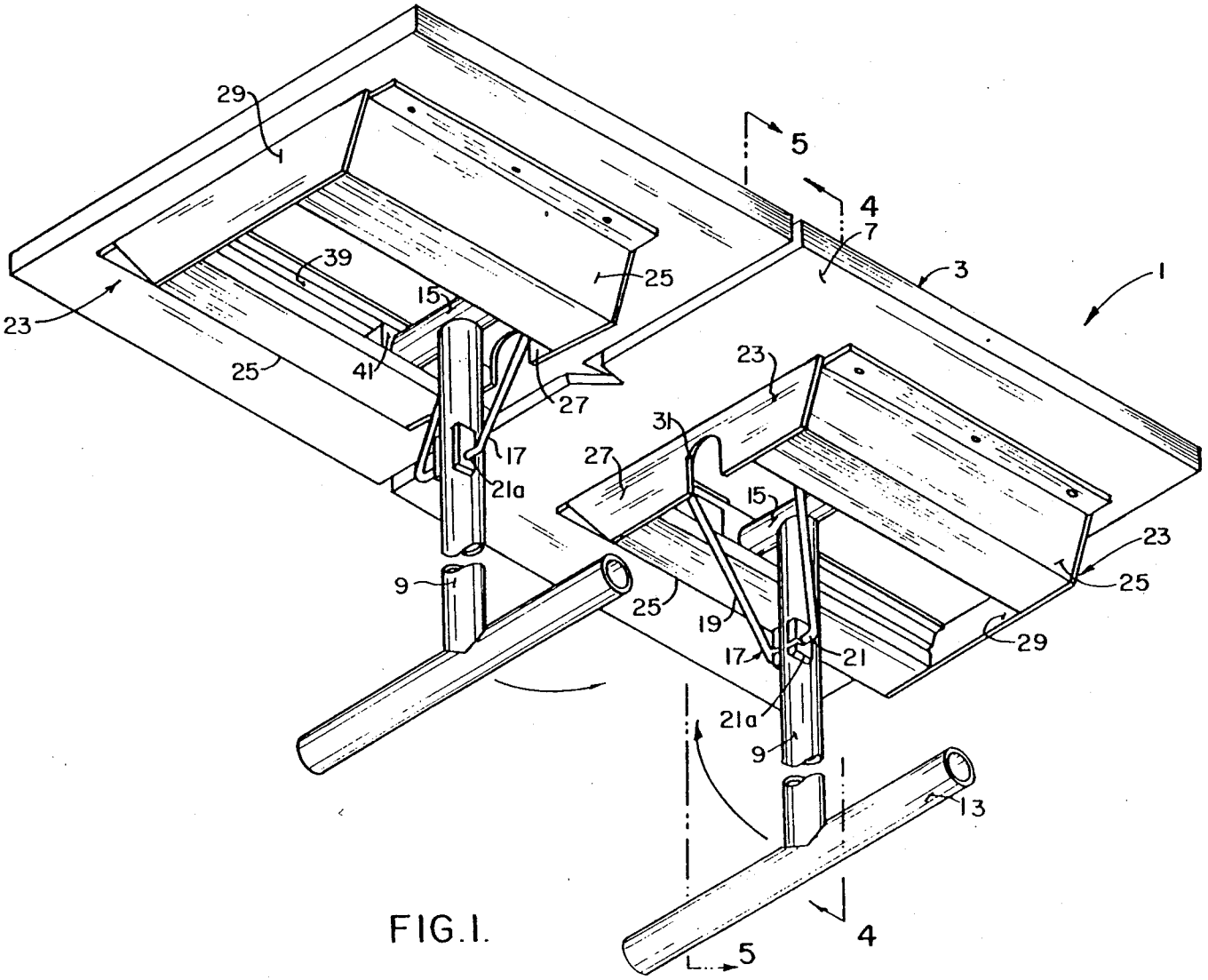
FIG. 1 is a fragmentary perspective view of the underside of a folding table of the present invention.
Figure 2:
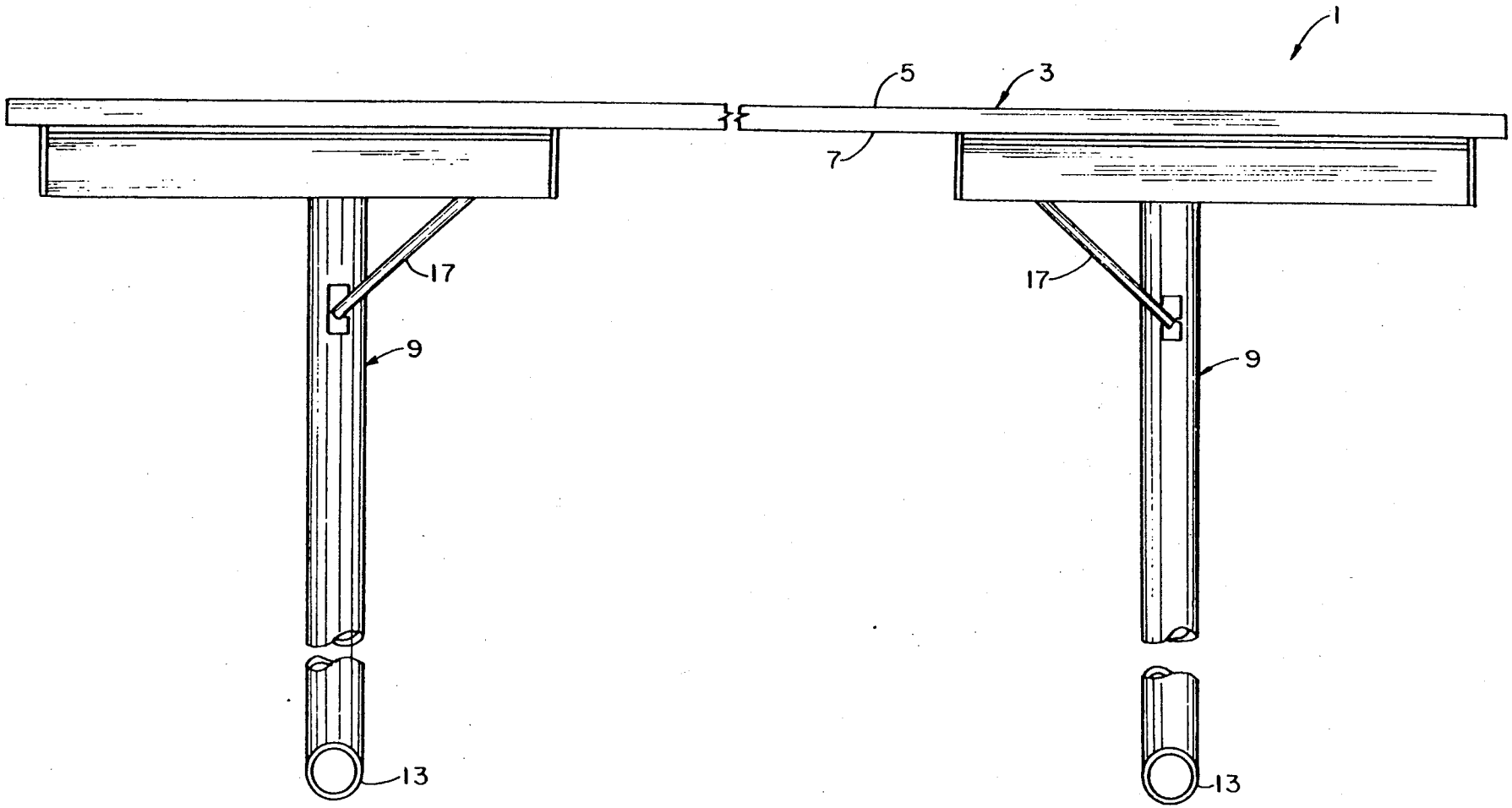
FIG. 2 is a fragmentary side elevational view of the folding table.

Referring initially to FIGS. 1 and 2, reference numeral 1 generally indicates the folding table of the present invention. Table 1 includes a table surface 3 having a top 5 and a bottom surface 7. Table 1 is supported by a pair of pivoting legs 9 each of which has a floor contacting member or foot 13 fixed to the bottom thereof and a release sleeve 15 fixed to the top thereof. As will be described below, each leg includes a column 9, which pivots about a point between sleeve 15 and foot 13, and the sleeves 15 slide along the bottom of table surface 3 to fold and unfold the table between its storage and usable positions.

A pair of support bars 17, comprising the intregal an arms 19 and a cross member 21, define points about which each leg 9 pivots when folding and unfolding the table 1. Support bar 19 is pivotally connected by the member 21 to leg 9 between the floor support 13 and sleeve 15. It is also pivotally connected to table bottom 7 by an end of arm 19 distant from the cross member 21 as will be described below. Support bars 17 are preferably formed of a single length of rod, pivotally connected to each column 9 by a yoke 21*a*. Thus, as can be seen in FIG. 1, as legs 9 are pivoted toward the table surface to collapse the table, the legs will pivot about the junction of the column 9 and support bars 17, and sleeve 15 will slide toward the respective ends of the under surface 3.

Figure 12B:
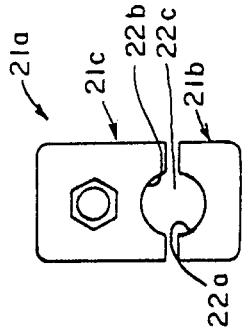
FIGS. 12A and 12B are top plan and front elevational views of the yoke.
Figure 12A:
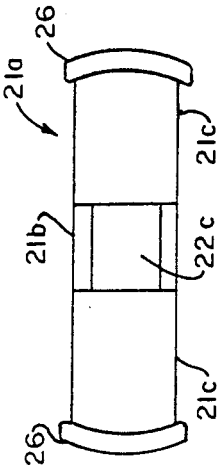
Figure 11:
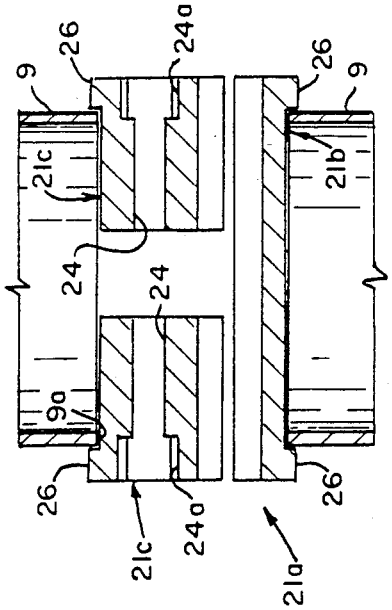
FIG. 11 is a cross sectional view of a yoke positioned in a leg of the table.

As seen in FIGS. 11 and 12, yoke 21A includes a lower portion 21B and a pair of identical upper portions 21C. Upper and lower portions 21B and 21C each include a semi-circular groove 22A and 22B, respectively to form a lower passage 22C which supports cross-member 21 in an enlarged aperture 9*a* in table leg 9. Upper portions 21C further include bores 24. In use, bottom portion 21B is passed through the leg aperture and rests on the bottom thereof. Support 17 is passed through the aperture above portion 21B so that cross-member 21 rests in groove 22A. The upper portions 21C of yoke 21A are then inserted in the openings on either side of leg 9 so that groove 22B covers cross-member 21. A bolt is then passed through bores 24 in upper portions 21C to hold yoke 21A in place. Bores 24 are preferably counterboard as at 24A so that the head of the bolt and the nut associated with the bolt are not exposed. Yoke 21A further includes a curved lip 26 which corresponds to the curvature leg 9.

As seen in FIG. 1, the column release sleeves 15 and support bars 17 are connected to the table surface 3 by a pair of what are defined as housings 23 which are fixed to its under surface 7. Each housing 23 includes a pair of side rails 25, a front end plate 27 and rear end plate 29. Front end plates 27 each have a cut-out 31 shaped to receive a leg column 9 when table 1 is folded into its collapsed form. The cut outs 31 allow the legs 9 to lie flat against table surface bottom 7 when the table is folded.

Figure 5:
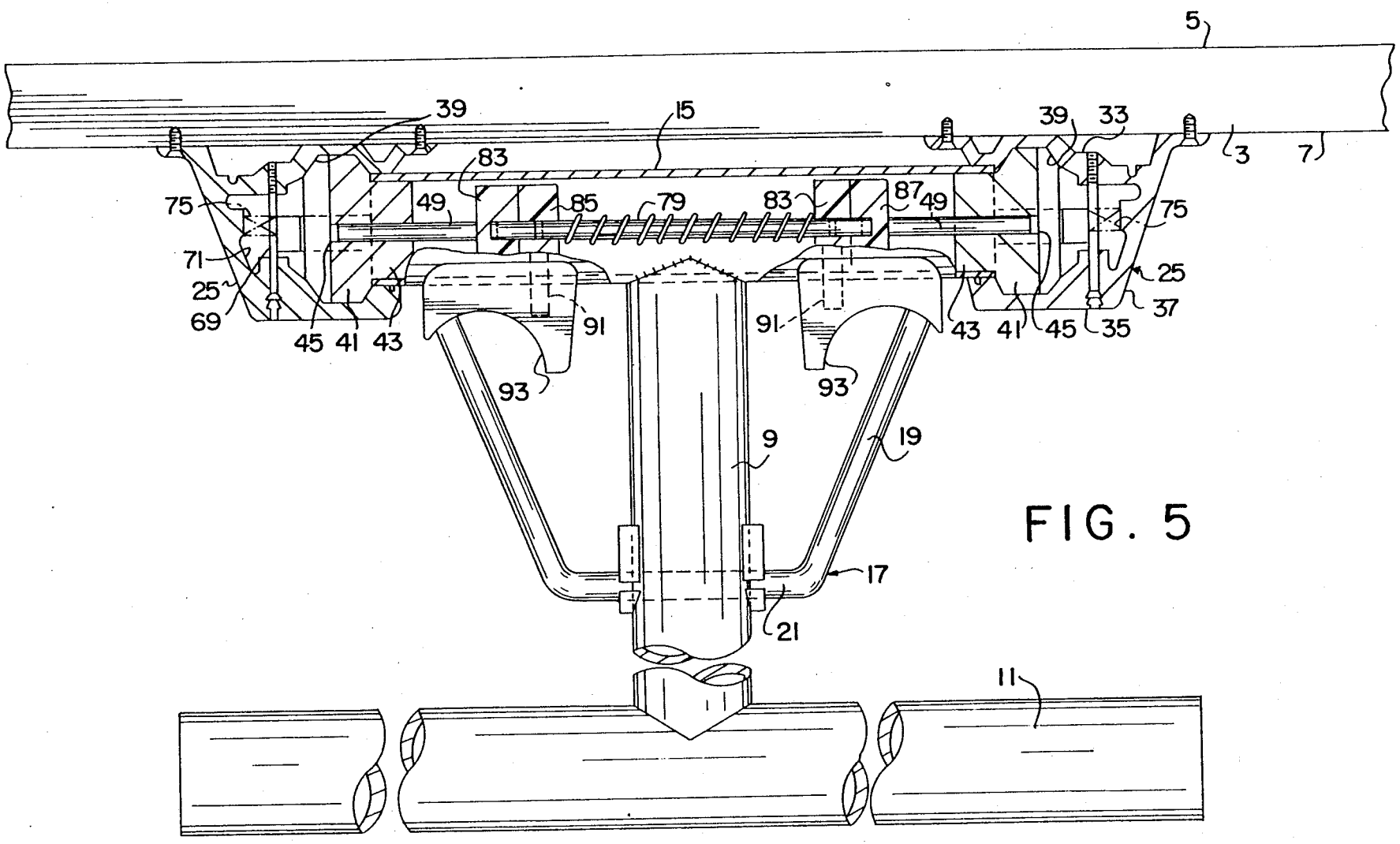
FIG. 5 is an elevational view taken along line 5—5 of FIG. 1.
Figure 7:
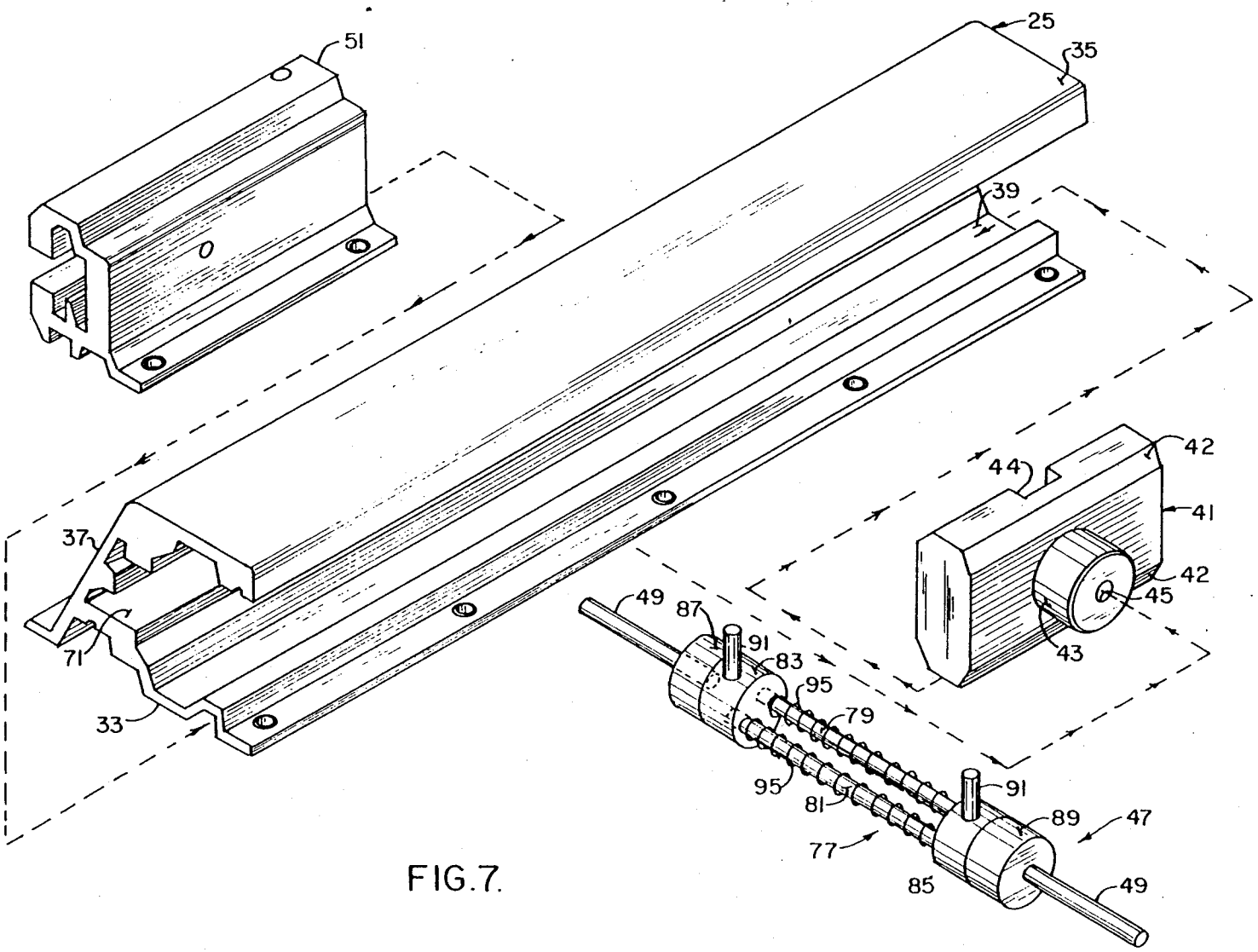
FIG. 7 is an exploded isometric view showing a side rail, an anchor, and an axle assembly.

Turning to FIGS. 5 and 7, each side rail 25 includes an integral extrusion formed of a top 33, a bottom 35 and an inclined outer wall 37, which together define an inner irregularly shaped groove 39 sized and shaped to snuggly receive a slide 41. The groove 39 extends the length of each side rail 25 and thus defines the path along which the slide 41 may move. Each slide 41 is preferably formed as an elongated rectangle shaped means wherein all its various edges are conveniently beveled to facilitate the movement. As also shown in FIG. 7, it includes a body having beveled corners 42, a notch 44, and an inwardly facing integral boss 43 arranged oppositely the notch. Boss 43 has a bore 45 which extends through the slide 41 to communicate within said notch 44.

An axle assembly 47, which is carried by sleeve 15, includes a pair of axle pins 49, each of which is pivotally received in the slide bores 45. Thus, the sleeve 15 of leg 9 can slide along the bottom 7 of table surface along the path defined by rail grooves 39.

Figure 6:
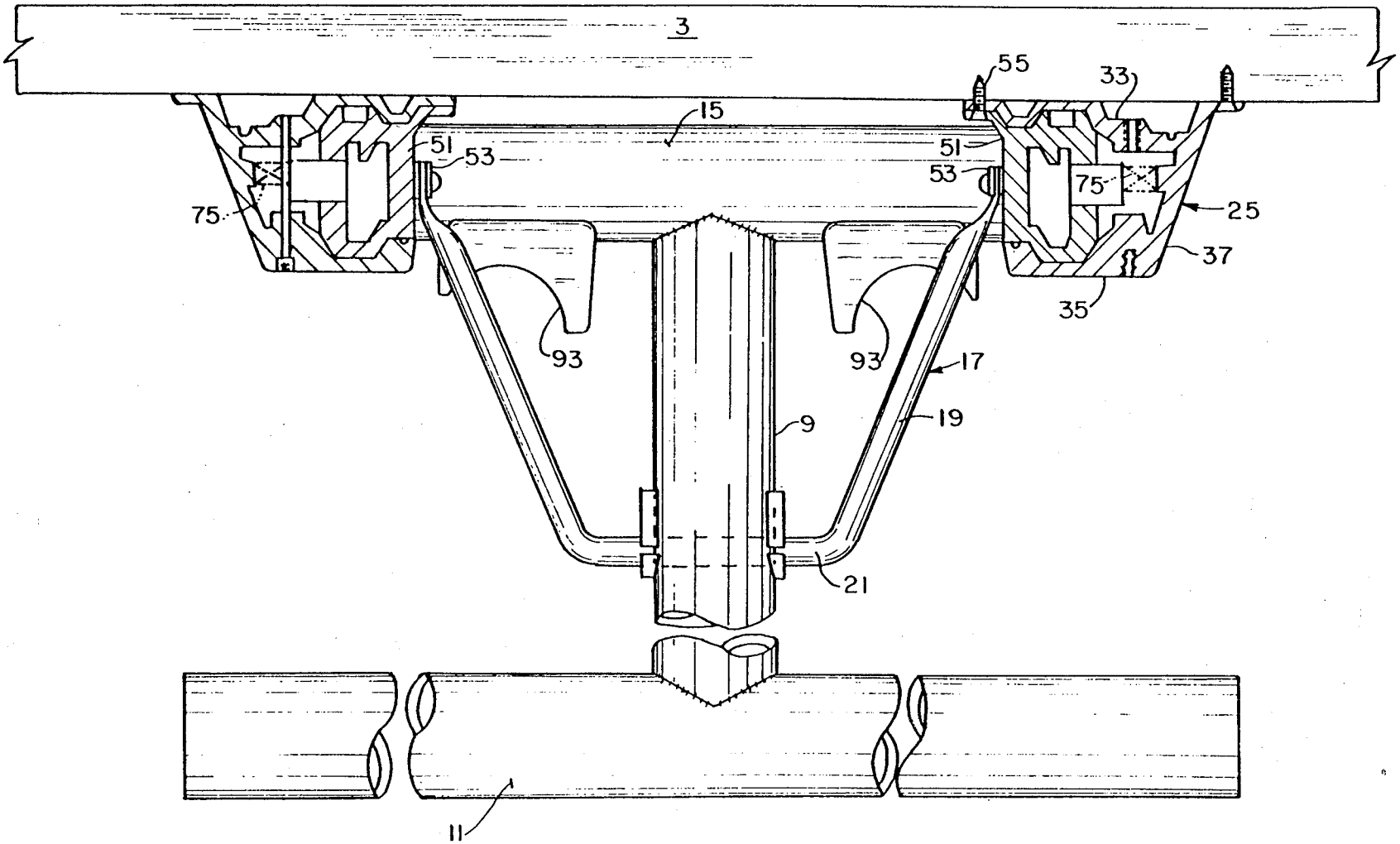
FIG. 6 is an elevational view taken along line 6—6 of FIG. 1.

As can be seen in FIG. 6, each support bar 17 is pivotally connected to an anchor 51 at an end 53 of each arm 19 remote from the cross member 21. Anchors 51 are sized and shaped to be tightly received in the inner ends of the grooves 39 of side rails 25. They are fixed in place by a plurality of screws 55 which extend through apertures in both the side rail and anchor to extend into table surface 3. Anchors 51 are fixed in housings 23 near the front end plates 27 so that sufficient clearance within the grooves 39 is provided to allow legs 9 to pivot between to their full folded to unfolded positions.

Figure 3:
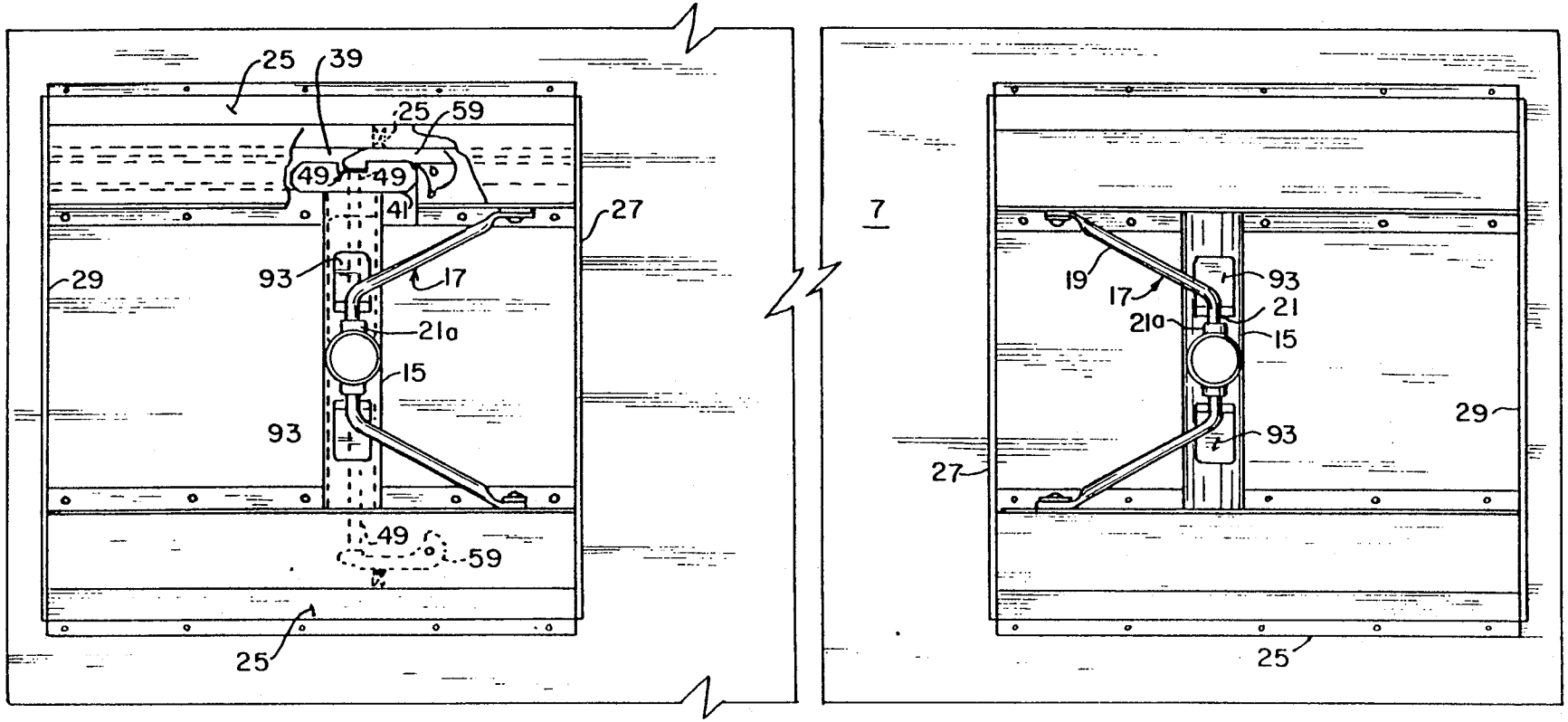
FIG. 3 is a bottom plan view of a table in an unfolded position partially broken away to show a locking mechanism of the invention embodied in one of the leg assemblies.
Figure 4:
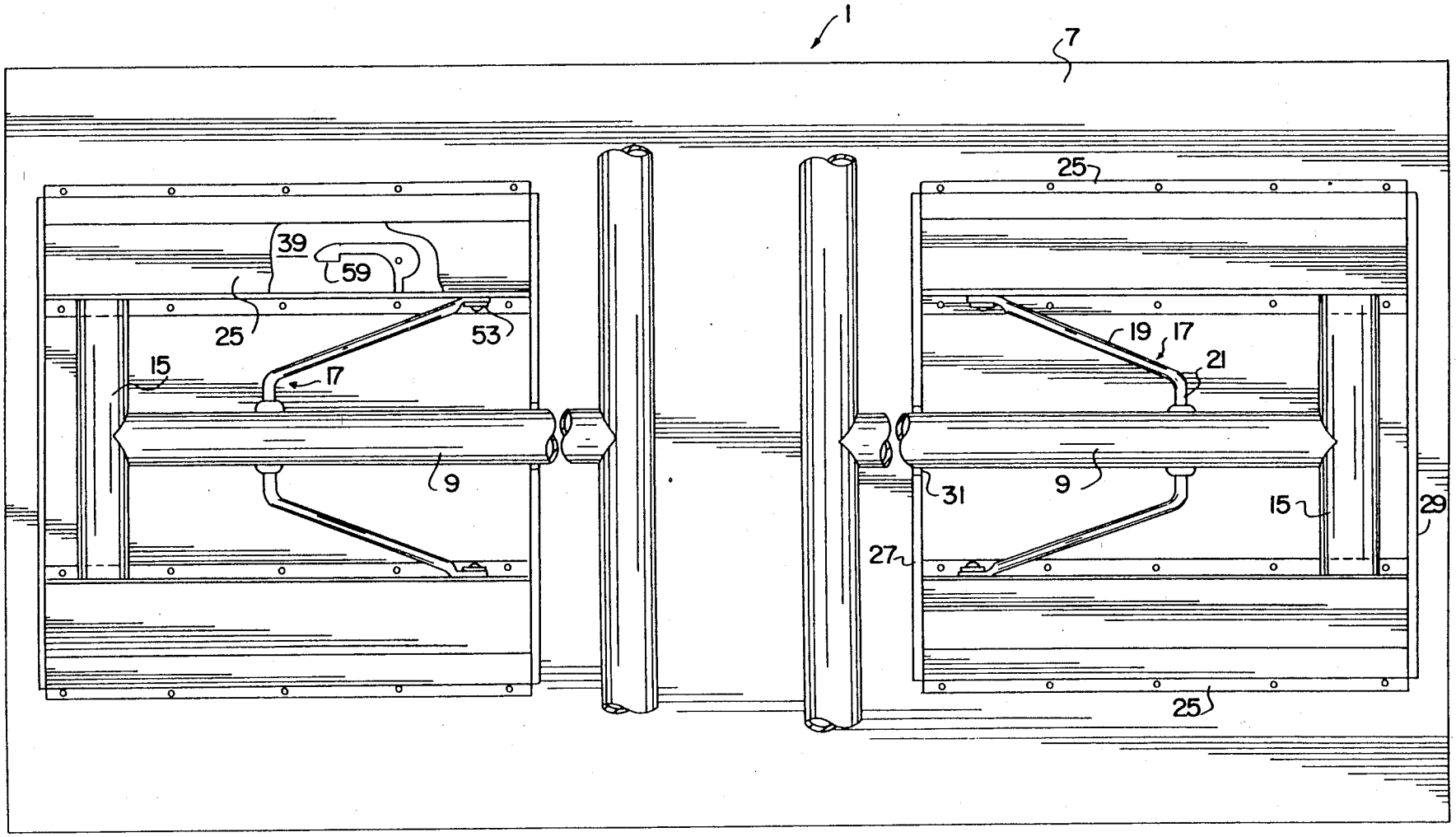
FIG. 4 is a plan view of the table similar to FIG. 3, but showing the table in a folded or collapsed position.
Figure 8:
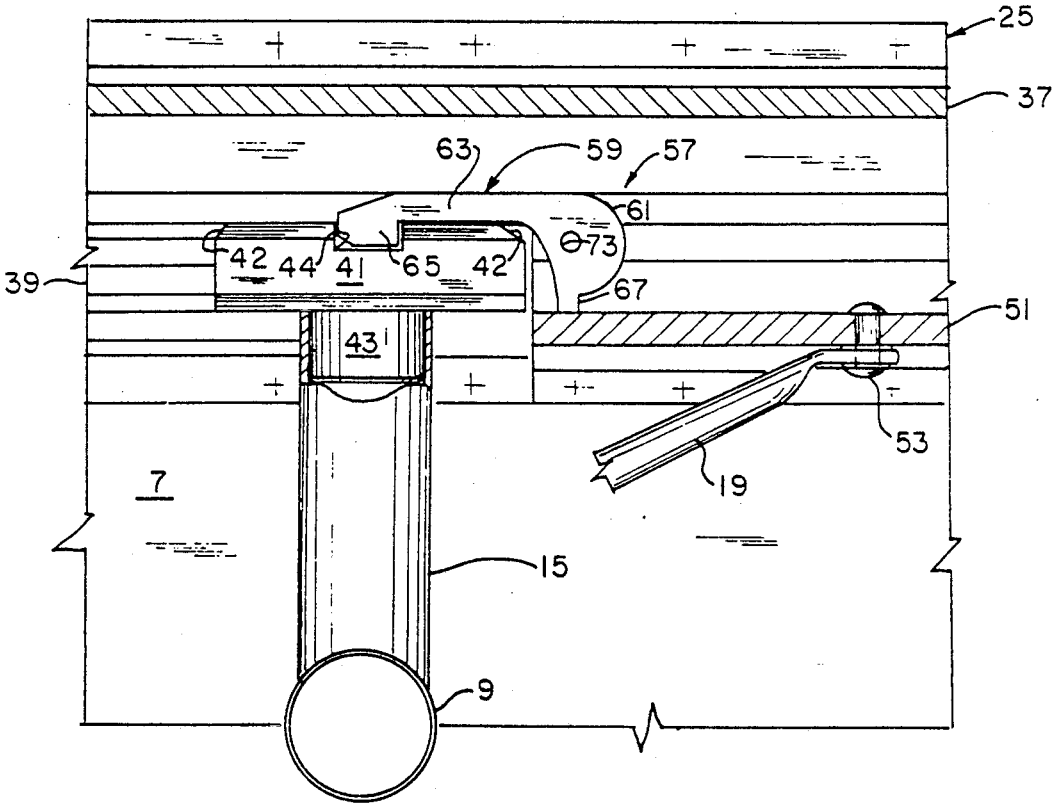
FIG. 8 is an enlarged view showing the latching mechanism.

Legs 9 are locked in their unfolded position by a locking mechanism 57 (FIGS. 3 and 8). There is at least one locking mechanism 57 for each leg. Preferably, there are four locking mechanisms 57, one associated with each slide 41. The locking mechanism includes a lever 59 having a base portion 61 from which an arm 63 and a finger 67 extend. Arm 63 has a latch 65 at its opposite end. Finger 67 is offset from arm 63 by approximately 90°.

A lever pin 69 (FIG. 5) extends vertically through a rear portion 71 of groove 39 between anchor 51 and back wall 37. Lever base 61 has a bore 73 therein through which lever pin 69 extends to pivotally mount lever 59 in the rear portion 71 of side rail groove 39. Lever 59 is preferably positioned so that arm 63 and latch 65 extend out from behind anchor 59. A spring 75 (FIGS. 3, 5 and 6) biases lever arm 63 and latch 65 away from rail back wall 31.

Latch 65 cooperates with slide notch 44 to lock leg 9 in its unfolded position. As a leg 9 is pulled away from table surface bottom 7, its sleeve 15 and slides 41 slide within the grooves 39 toward anchors 51 and levers 59. When a slide 41 contacts a lever 59, its beveled corner 42 pushes lever arm 59 away from slide 41. As the slide 41 moves further, the latch 65 is aligned with the slide notch 44 and is then urged into notch 44 by spring 75 to securely and snuggly lock leg 9 in a stable, upright, unfolded position, readying the table for usage.

A release mechanism 77 (FIGS. 5, 7, 9 and 10) forces lever latch 65 out of slide notch 44 so that table 1 may be folded and stored. Release mechanism 77 preferably is part of the axle assembly 47. There is one release mechanism 77 for each locking mechanism 57.

Release mechanism 77 includes a pair of extender rods 79 and 81 each of which are fixed to one of a pair of inner bushings 83 and 85 and slidably journaled through a bore in the other of bushings 83 and 85. Each rod 79 and 81 is fixed to an inner surface of one of a pair of outer bushing 87 and 88. Axle pins 49 are fixed to the outer surface of outer bushings 87 and 88. Therefore, extender rod 79 is fixed to inner bushing 85, is slidably journalled through a bore in inner bushing 83, and fixed to outer bushing 87. Extender rod 81 is mounted exactly opposite this. Therefore, when inner bushing 83 and 85 are pulled together, rod 79 slides through bushing 83 and rod 81 slides through bushing 85 thereby pushing bushings 87 and 89, and axle pins 49, outward. As axle pins 49 are pushed outwardly, they pass through slide bores 45 into slide notches 44 to push latches 65 out of notches 44 thereby releasing legs 9 and allowing table 1 to be folded and collapsed.

Inner bushings 83 and 85 have upwardly extending pins 91 which extend through slots (not shown) in sleeve 15. Finger grips 93, which are fixed to the top of pins 91, are arranged on the surface of the sleeve 15, and facilitate pulling the inner bushings 83 and 85 together.

Figure 9:
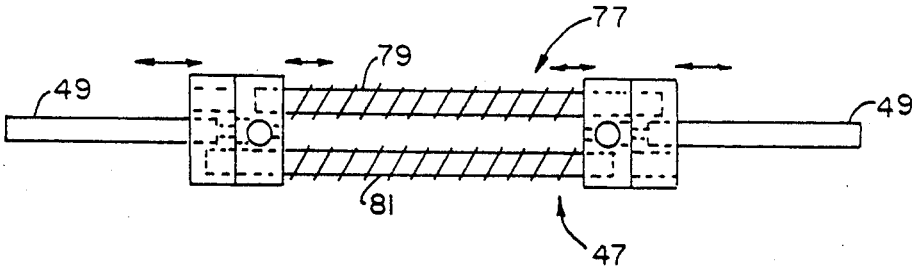
FIG. 9 is a top plan view of a release mechanism of the present invention in a retracted position.
Figure 10:
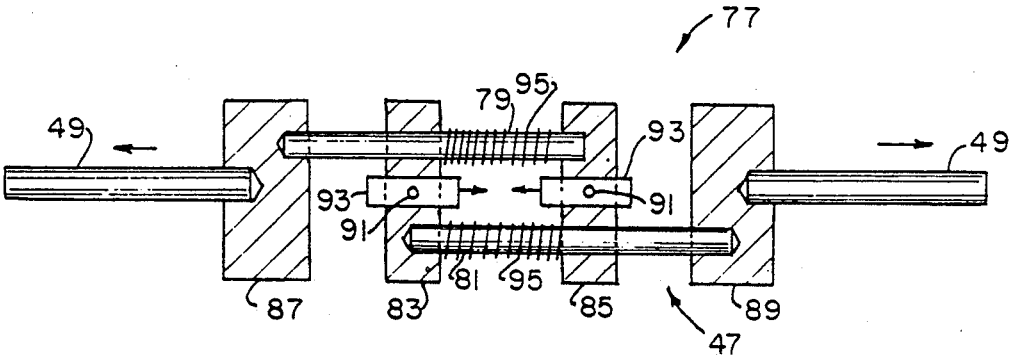
FIG. 10 is a top plan view of the release mechanism in an extended position.

A pair of springs 95 are mounted on extender rods 79 and 81 between inner bushings 83 and 85 to normally bias the release mechanism 77 toward a retracted or relaxed position as in FIG. 9. Thus, when the release mechanism 77 is extended, as in FIG. 10, to release the lock mechanism 57, when finger grips 93 are released, mechanism 77 will return to its normal, retracted position. Springs, could, alternatively be mounted on axle pins 49 between the outer bushings 87, 89 and slide 41, to bias mechanism 77 to its retracted position.

Figure 14:
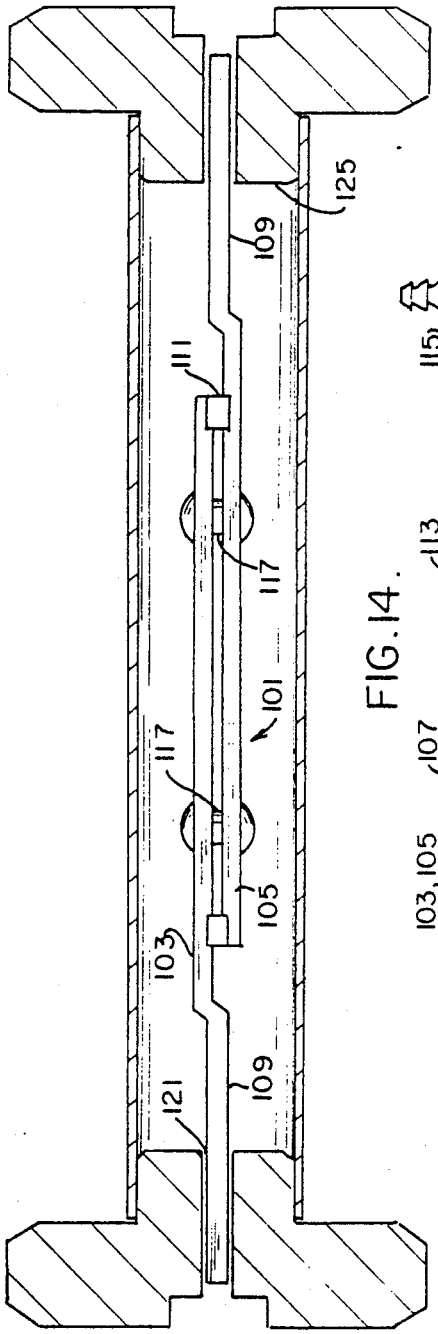
FIG. 14 is a cross sectional view of the release mechanism of FIG. 12 and is assembled in a sleeve and connected to slides.
Figure 13:
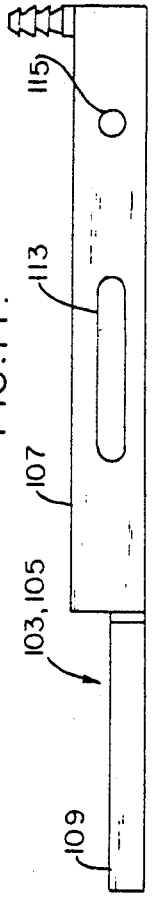
FIG. 13 is a front elevational view of another release mechanism.

FIGS. 13 and 14 show another release mechanism 101. Release mechanism 101 includes a pair of identical sliding members 103 and 105. Each member 103 and 105 includes a generally rectangular body 107 having an arm 109 extending axially from one end thereof, and a button 111 extending perpendicularly therefrom at an end remote from arm 109. Arm 109 is preferably approximately one-half the height of body 107 and it is axially offset from body 107 in the same direction as button 111. Body 107 further includes an elongate slot 113 and a hole 115. Hole 115 is positioned approximately one-fifth of the length of body 107 in from button 111. Slot 113 begins approximately one-quarter of the length of body 107 in from arm 109 and extends to a spot approximately in the middle of body 107.

Members 103 and 105 are assembled such that buttons 111 face inwardly to appropriately space the two members apart. Members 103 and 105 are slidably connected by a pair of top shoulder rivets 117. Each rivet 117 extends through hole 115 of one of the members 103 and 105 and through the elongate slot 113 of the other member, thus allowing the two members to slide relative to one another along a path defined by slot 113. Arms 109 are received in slots 121 of slide 123. Slide 123 is substantially similar to slide 41. Release mechanism 101 is received within sleeve 15 and held therein by slide bosses 125 in the same manner as release mechanism 77.

Figure 15:
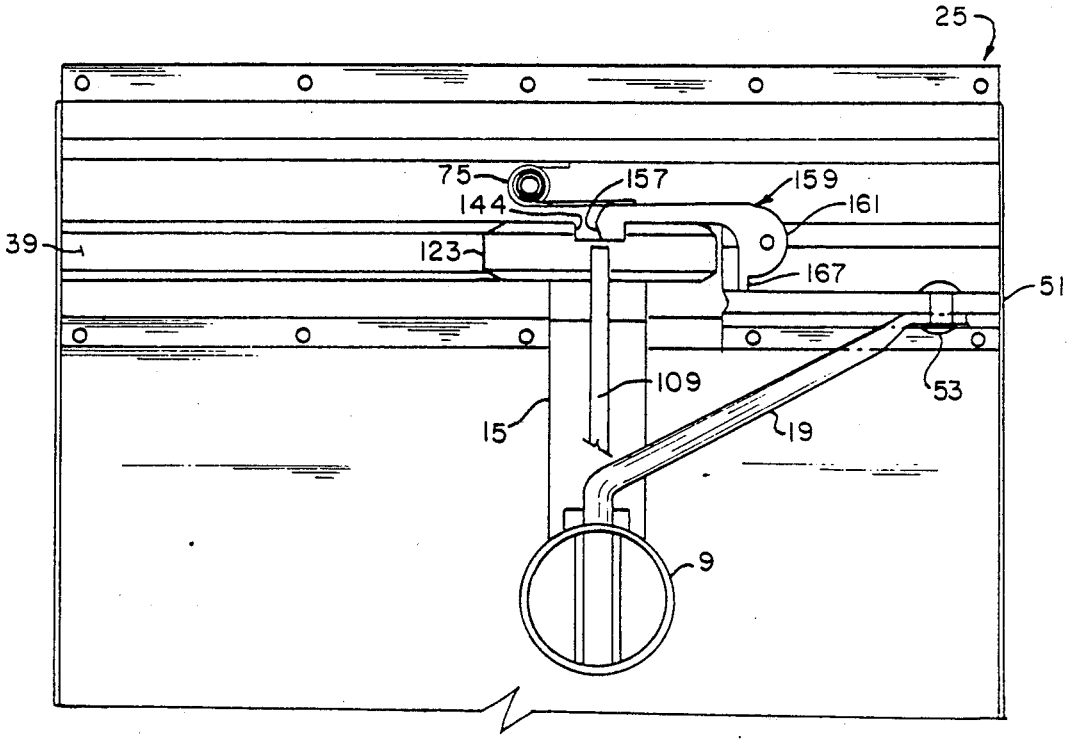
FIG. 15 shows the release mechanism of FIG. 13 positioned in a slide rail.

Turning to FIG. 15, release mechanism 101 operates in much the same manner as release mechanism 77. Mechanism 101 has a pair of barbs 127 which receive finger grips. When barbs 127 are pulled toward one another, arms 109 are extended outwardly to push the finger 157 of lever 159 out of notch 144 of slide 123, thereby releasing slide 123 from leg 9 so that the table can be folded.

Lever 159 is biased inwardly by spring 75. When table 1 is in an unfolded position. the finger 157 of lever 159 is held in notch 144 by spring 75 so that lever 159 will maintain slide 123 in place thereby preventing a collapse of table 1.

Figure 16:
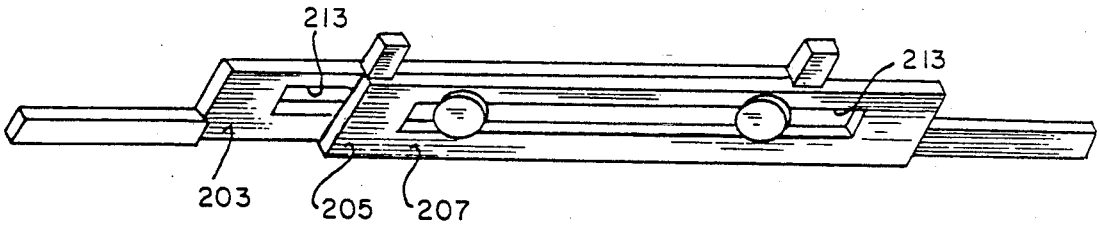
FIG. 16 is a perspective view of yet another release mechanism.

FIG. 16 shows a release mechanism 201 that is substantially similar release mechanism 101. However. rather than having elongate slot and a hole. release mechanism 201 includes a single slot 213 in the body 207 of each of its members 203 and 205. Slot 213 extends nearly the length of body 207. A small margin exists between either end of the slot 213 and either end of the body 207. The two members are similarly slidably joined. The use of the single long slot 213 provides for a greater sliding range.

Release mechanism 101 or 201 is the preferred mechanism to be used with table 1.

Figure 17:
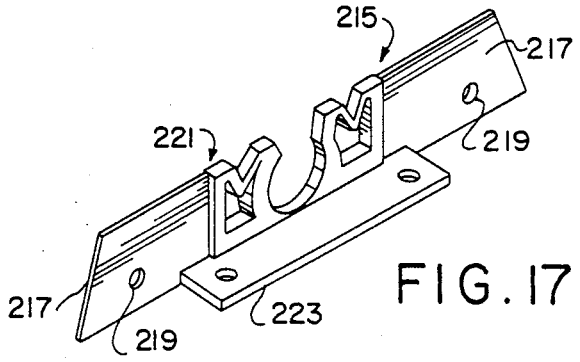
FIG. 17 is an isometric view of a modification to the end plate of this invention.
Figure 18:
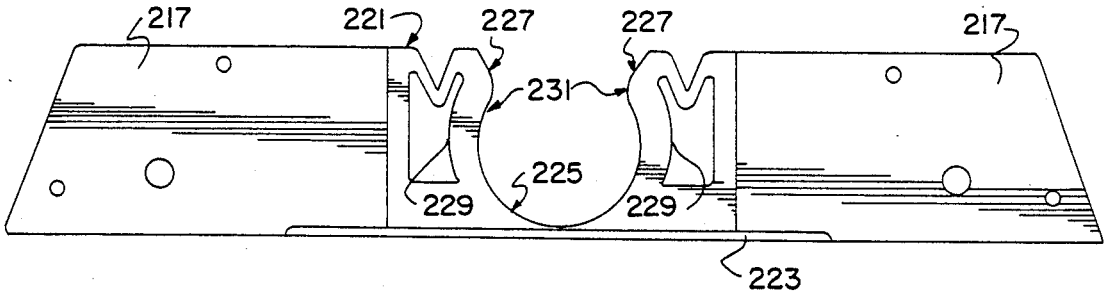
FIG. 18 is a front view thereof.
Figure 19:
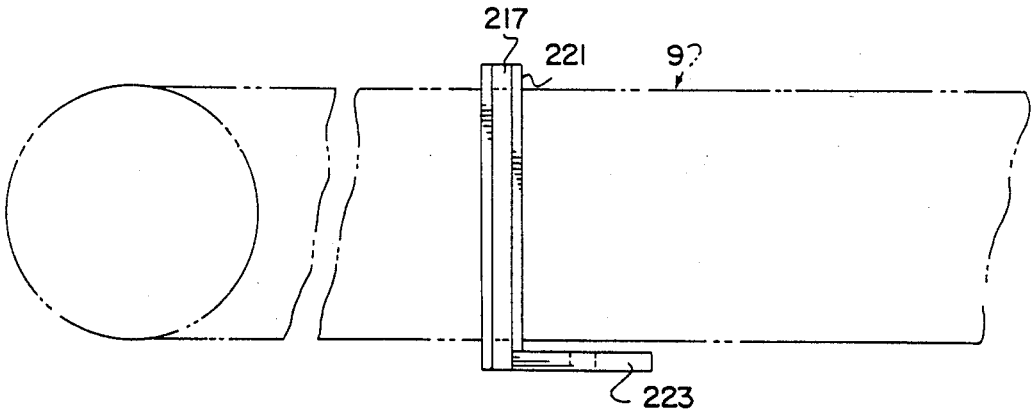
FIG. 19 is a side view of an end plate, showing, in phantom line, a table leg embraced as during table closure.

FIGS. 17 through 19 disclose a modification to the end plate 29 of this invention. In this particular instance, the end plate 215 is molded from a polymer or rubberized material, and has inherent resiliency, although sufficient stiffness to function in the category as the end plate, such as that described for the end plate 29. In this particular instance, the outer flanges, as at 217, are formed having a thickness of approximately $\frac{1}{8}$ inch, but of sufficient thickness to provide for its stability when held by fasteners, such as extending through the apertures 219, when secured to the end of the substructure for the table, as previously identified. The central but integral portion of the end plate, as at 221, is formed of the same material, but slightly thicker, preferably about $\frac{1}{4}$ inch in thickness, and provides the means for holding the table leg in place, when the table is folded into its collapsed condition. At the bottom of the end plate is formed an integral flange, as at 223, to provide a supplemental means for fastening of the end plate to the table subsurface, when secured into position. as a supplemental means for holding the end plate in place. Apertures are provided for accommodating fasteners, such as screws, therethrough, for assuring its retention. As can be seen in FIG. 18, the center portion 221 has a unique configuration, generally formed having a central opening, as at 225, and having a dimension approximately equal to, or slightly greater, than the dimension of the table leg 9. In addition, the upper opening of the opening 225 is flared outwardly, as at 227, in order to guide the table leg 9 into position for retention within the opening 225. Furthermore, there are cutout portions, which are molded in the form of the apertures 229, as shown, and the purpose of these apertures, as located, is to provide for a slight collapsing or expansion of the opening 225, particularly at the location of its flares 227, so as to assure that the table leg 9 can be forced into position within said opening 225, to maintain its retention therein, such that when the table leg is disposed therein, and the protruding portions 231 will embrace the upper portion of the table leg 9, and assure its retention therein, as when the table is collapsed for nonuse. This is just an example of a modification to the table structure, to render the table more facile of application, or collapsed for storage, when generally utilized by the owner.

Numerous variations, within the scope of the appended claims, may be apparent to those skilled in the art in light of the foregoing description and accompanying drawings. For example, one housing could be used instead of the two housing as described above. If there were one housing, anchors 51 would act as stops to prevent slides 41 from sliding too far in the grooves 39. This example is merely illustrative.

Having thus described the invention, what is claimed and desired to be secured by Letters Patent is:

1. A stable folding table comprising a table surface having a top surface and a bottom surface, at least one housing secured to the table surface bottom, said housing slidably and rotatably receiving a pair of table legs, said housing including means for moving said legs between a folded position and a supporting position, means for locking said legs in said supporting position, means for releasing said legs from said locking means, said legs each include a floor contacting member fixed to the bottom thereof, a release sleeve fixed to the top thereof, and a support pivotally fixed at one end to said leg intermediate said member and said sleeve and at another end to said housing.

2. The folding table of claim 1, wherein said housing comprises a pair of spaced apart, generally parallel side rails, each of said side rails defining a groove therein which extends the length thereof.

3. The folding table of claim 2, wherein said sleeve is slidably retained to each said housing groove.

4. The folding table of claim 3 and including a slide disposed in each said rail groove, and said sleeve retained to each opposing side.

5. The folding table of claim 4, wherein each said leg further includes an axle assembly carried in said release sleeve, said axle assembly including an axle pin means which is received in each pair of opposing slides, said slides being slidably received in each said groove.

6. The folding table of claim 5, wherein at least one of said slides includes a notch on an outer surface thereof opposite the surface adjacent said sleeve, said locking means comprising a lever pivotably fixed in said side rail, said lever including a latch which cooperates with said slide notch to lock its associated leg and table in an erected position.

7. The folding table of claim 6, wherein said lever is biased to urge said latch toward said notch for engagement.

8. The folding table of claim 6, wherein each said slide includes a passage which receives said axle pin means, at least one of said passage extending through said slide to said notch in said at least one slide, said release means comprising extension means for extending said axle pin through said passage so that said axle pin means will urge said latch to disengage from said notch.

9. The folding table of claim 8, wherein said axle pin means comprises two pins, there being one pin on each end of said axle assembly, said extension means comprising a first and a second extender rod, said first extender rod being fixed to a first inner bushing, slidably received in a bore of a second inner bushing to pass therethrough and fixed to a first outer bushing, one of said pins being fixed thereto; said second extender rod being fixed to said second inner bushing, slidably received in a bore which extends through said first inner bushing, and fixed to a second outer bushing, the other of said pins being fixed to said second outer bushing; said first and second inner bushings being slidable relative to one another over said extender bars; whereby, when said inner bushings are brought together, said axle pins are extended for disengaging said latches.

10. A locking assembly to lock legs of a folding table in a supporting position, said table comprising a table surface having a top and a bottom, each of said legs including a sleeve at the top thereof, said sleeve being pivotably mounted on either side thereof relative to a slide having an engaging means on a side opposite said sleeve, each said slide being slidably received in a groove of a rail which is fixed to the bottom of said table surface, wherein said locking assembly comprises a lever pivotally fixed in said groove, said lever including a catch which cooperates with said notch to lock said head, and hence said leg, in a supporting position.

11. The locking assembly of claim 10, wherein said lever is biased to normally be urged against said slide.

12. The locking assembly of claim 10, said locking assembly further including release means for releasing said slide from said latch.

13. The locking assembly of claim 12, wherein said release means includes an axle assembly carried in said sleeve, said axle assembly having a pair of arms which are received in pasages which extend through said slide to each said notch and extender means for extending said arms through said slide passages to urge each said catch out of each said notch.

14. The locking assembly of claim 11, wherein said extension means comprises a first and a second extender rod, said first extender rod being fixed to a first inner bushing, slidably received in a bore of a second inner bushing to pass therethrough and fixed to a first outer bushing, one of said axle pins being fixed thereto; said second extender rod being fixed to said second inner bushing, slidably received in a bore which extends through said first inner bushing, and fixed to a second outer bushing, the other of said axle pins being fixed to said second outer bushing; said first and second outer bushings being slidable relative to one another over to said extender bars; whereby, when said inner bushings are brought together, the axle pins are extended.

15. The locking assembly of claim 14, wherein springs are mounted on said first and said second extender rods between said first and said second inner bushings to normally bias said extender means to a retracted position.

16. The locking assembly of claim 11 wherein said extension means comprises a pair of sliding members slidably connected for axial movement relative to one another, each said member including a body having an extender arm which is slidably received in each of said slide passage, whereby when said members are moved relative to one another, said extender arms slide in said slide passage to urge said lever from said slide.

17. The folding table of claim 8 wherein said axle pin means comprises a pair of sliding members slidably connected for axial movement relative to one another, each said member including a body having an extender arm which is slidably received in said slide passage, whereby when said members are moved relative to one another, said extender arm slides in said slide passage to urge said lever from said slide.

18. The folding table of claim 2 and including end plates provided at least at one end of the parallel side rails, said end plates having an opening therein so as to accommodate the disposition of a table leg when the table is collapsed for nonusage.

19. The folding table of claim 18 and wherein said end plates being at least partially formed of resilient material so that when the table legs are collapsed into the end plates, said legs are held therein by means of the end plate resiliency.

20. The invention of claim 19 and wherein said resilient end plate is formed of polymer material.

21. A stable folding table comprising a table surface having a top surface and a bottom surface, at least one housing secured to the table surface bottom, said housing slidably and rotatably receiving a pair of table legs, said table legs being independent and noncontacting of each other, said housing including means for independently sliding said legs between a folded position and a supporting position, and means for locking said legs in said supporting position, and means for releasing said legs from said locking means.

22. The folding table of claim 21 and including a release sleeve fixed to the top of each said leg to facilitate the shifting of the legs between their supporting and folded positions.

* * * * *

UNITED STATES PATENT AND TRADEMARK OFFICE

CERTIFICATE OF CORRECTION

PATENT NO. : 5,109,778

DATED : May 5, 1992

INVENTOR(S) : Alan Berkowitz; Elliott W. Baum; Curt Angel

It is certified that error appears in the above-identified patent and that said Letters Patent is hereby corrected as shown below:

Column 8, claim 10, line 9, change "head" to

---sleeve---.

Signed and Sealed this

Sixth Day of July, 1993

*Attest:*

Michael K. Kirk

MICHAEL K. KIRK

*Attesting Officer*

*Acting Commissioner of Patents and Trademarks*